US005741618A

United States Patent [19]

Shigemori et al.

[11] Patent Number: 5,741,618

[45] Date of Patent: Apr. 21, 1998

[54] PROCESS FOR PRODUCING POLYMER TONER

[75] Inventors: Kazunori Shigemori; Tokudai Ogawa, both of Kanagawa-ken, Japan

[73] Assignee: Nippon Zeon Co. Ltd., Japan

[21] Appl. No.: 728,475

[22] Filed: Oct. 10, 1996

[30] Foreign Application Priority Data

Oct. 12, 1995 [JP] Japan ..... 7-290447

[51] Int. Cl.[6] ..... G03G 5/00

[52] U.S. Cl. ..... 430/137; 430/109; 523/223; 524/779; 524/832; 524/836

[58] Field of Search ..... 430/137, 109; 523/223; 524/779, 832, 836

[56] References Cited

U.S. PATENT DOCUMENTS

| | | | |
|---|---|---|---|
| 4,077,804 | 3/1978 | Vanzo | 430/137 |
| 4,330,460 | 5/1982 | Hoffend et al. | 524/849 |
| 4,601,968 | 7/1986 | Hyosu | 430/137 |
| 4,626,489 | 12/1986 | Hyosu | 430/137 |
| 4,804,610 | 2/1989 | Mori et al. | 430/137 |
| 5,130,220 | 7/1992 | Nakamura et al. | 430/137 |
| 5,217,839 | 6/1993 | Yamada et al. | 430/137 |
| 5,427,885 | 6/1995 | Ota et al. | 430/137 |

FOREIGN PATENT DOCUMENTS

| | | | |
|---|---|---|---|
| 59-123852 | 7/1984 | Japan | 430/137 |

*Primary Examiner*—George F. Lesmes
*Assistant Examiner*—Steven H. VerSteeg
*Attorney, Agent, or Firm*—Armstrong, Westerman, Hattori, McLeland & Naughton

[57] ABSTRACT

A process for producing a polymer toner comprises the steps of pouring a polymerizable monomer composition containing at least a polymerizable monomer and a colorant, but containing no oil-soluble polymerization initiator into an aqueous dispersion medium containing a dispersing agent; adding an oil-soluble polymerization initiator to the polymerizable monomer composition while stirring the composition to form primary droplets thereof, thereby bringing the droplets of the polymerizable monomer composition into contact with droplets of the oil-soluble polymerization initiator to form droplets of a polymerizable monomer composition containing the oil-soluble polymerization initiator; further continuing the stirring to form secondary droplets having desired droplet sizes; and then conducting suspension polymerization of the polymerizable monomer composition.

14 Claims, No Drawings

PROCESS FOR PRODUCING POLYMER TONER

FIELD OF THE INVENTION

The present invention relates to a process for producing a toner for developing electrostatic latent images to be used in electrophotography, electrostatic recording, electrostatic printing, etc., and more particularly to an improved process for producing colored particulate polymer (polymer toner) by a suspension polymerization method.

BACKGROUND OF THE INVENTION

In an electrophotographic process, an electrostatic latent image is formed on a photosensitive member (a photoconductor) evenly charged by exposure to a light pattern, and colored, charged particles (toner) are applied to the electrostatic latent image to make a visible image (toner image). The toner image is transferred to transfer paper, and the unfixed toner image is then fixed to the paper by a method such as heating. As the toner, there is used a toner obtained by dispersing a colorant such as carbon black and other additives in a thermoplastic resin and granulating the dispersion.

As a production process of a toner to be used in the development of electrostatic latent images, there has heretofore been known a process in which a thermoplastic resin, a colorant and optional other additives are fusion-mixed, the mixture is ground, and the ground product is classified so as to obtain a particulate matter having desired particle sizes. In this grinding method, it is necessary for the mixture of the thermoplastic resin and the colorant to have brittleness to such an extent that it can be easily ground. When such a mixture is actually ground at a high speed, however, particles having a wide particle size distribution are liable to be formed. In the case where a toner is provided as fine particles, in particular, for the purpose of enhancing the resolution of a copied product, fine particles ground in excess are generated in a great amount. In order for a toner to exhibit satisfactory developing characteristics, the toner must have a particle size distribution limited to some extent. Therefore, classification is required for the purpose of obtaining a toner having a desired particle size distribution from a ground product containing a great amount of fine particles. However, its yield is poor, and so the percent yield thereof is reduced to a great extent.

On the other hand, when a toner is produced in accordance with a suspension polymerization method, a colored particulate polymer (polymer toner) can be produced without a grinding step. In the suspension polymerization method, a polymerizable monomer composition comprising a polymerizable monomer, a colorant, an oil-soluble polymerization initiator and further optionally a crosslinking agent, a charge control agent and other additives dissolved or dispersed uniformly is prepared and then dispersed in an aqueous dispersion medium containing a dispersion stabilizer by means of a stirrer to form minute droplets of the polymerizable monomer composition (a step of forming droplets), and the dispersion containing the minute droplets are then heated to conduct suspension polymerization of the polymerizable monomer composition, thereby obtaining a polymer toner having desired particle sizes. The polymer toner obtained by the suspension polymerization method is spherical in shape, has an even surface and exhibits good developing characteristics. However, the suspension polymerization method involves the following problems to be solved.

In order for a toner to exhibit good developing characteristics, it is desirable that the toner have a homogeneous composition and an even particle size distribution. In order to obtain a polymer toner having a homogeneous composition and an even particle size distribution in accordance with the suspension polymerization method, it is necessary to disperse the colorant and the polymerization initiator in the polymerizable monomer to conduct polymerization, and further to evenly and stably form droplets of the polymerizable monomer composition in the aqueous dispersion medium to conduct polymerization. Namely, it is necessary to disperse the additives such as the colorant in the droplets of the polymerizable monomer composition in order to obtain a polymer toner having uniform properties. When the suspended droplets of the polymerizable monomer composition aggregate, or the droplet size distribution of the droplets becomes wide, it is impossible to obtain a polymer toner having an even particle size distribution.

Since the polymer toner obtained by the suspension polymerization method is composed of particles formed by the polymerization of the droplets of the polymerizable monomer composition dispersed in the aqueous dispersion medium, its properties are greatly influenced by the state of the original droplets. However, it has been very difficult to form homogeneous and even droplets. In addition, the properties of the polymer toner are also influenced by resin properties such as polymerization degree and crosslinking degree of a polymer to be formed by the suspension polymerization. However, it has been extremely difficult to make these resin properties uniform at every polymer toner particle.

For example, in order to make the dispersion of the colorant in the polymerizable monomer even, many methods such as a method of treating a colorant and a method of adding a dispersing agent for a colorant have heretofore been proposed. In order to make resin properties such as polymerization degree and crosslinking degree uniform at every polymer toner particle, however, it is necessary to evenly disperse an oil-soluble polymerization initiator in the droplets of the polymerizable monomer composition. In order to obtain a homogeneous polymerizable monomer composition, there has hitherto been proposed a process comprising adding a colorant, an oil-soluble polymerization initiator and further optionally a crosslinking agent, a charge control agent and other additives dissolved or dispersed uniformly to a polymerizable monomer containing a polymerization inhibitor and then applying mechanical shearing force (for example, by mixing in a ball mill) to the mixture, thereby uniformly dissolving or dispersing the individual components in the polymerizable monomer (U.S. Pat. No. 4,804,610). According to this process, a composition with the individual components such as the oil-soluble polymerization initiator uniformly dispersed in the polymerizable monomer can be prepared by applying high shearing force.

However, such a process has involved problems that a partial polymerization reaction is easy to occur from an initial stage after the preparation of the polymerizable monomer composition in spite of the coexistence of the polymerization inhibitor because the polymerization initiator is contained in this composition, and that when mass treatment is carried out, in particular, on an industrial scale, a run-away reaction tends to occur due to heat accumulation. Accordingly, when the polymerizable monomer composition is used to form droplets thereof and conduct suspension polymerization, a polymer toner having ununiform resin properties is liable to be formed.

OBJECTS AND SUMMARY OF THE INVENTION

It is an object of the present invention to provide a process for producing a polymer toner having a homogeneous composition and an even particle size distribution in accordance with the suspension polymerization method.

The present inventors have conceived of a process in which a polymerizable monomer composition containing at least a polymerizable monomer and a colorant, but containing no oil-soluble polymerization initiator is prepared, and an oil-soluble polymerization initiator is then included in the composition in an aqueous dispersion medium. According to this process, neither partial polymerization reaction nor run-away reaction is brought on at a stage of the preparation of the polymerizable monomer composition because no oil-soluble polymerization initiator is added thereto, and so a polymerizable monomer composition having a homogeneous composition can be prepared by application of high shearing force through stirring.

When the oil-soluble polymerization initiator is added after the polymerizable monomer composition is formed into droplets having desired droplet sizes in the aqueous dispersion medium, however, it is difficult to uniformly disperse the oil-soluble polymerization initiator in the droplets, resulting in difficulty in making resin properties such as polymerization degree and crosslinking degree uniform at every polymer toner particle. The term "formation into droplets having desired droplet sizes" as used herein means that droplets are evenly, finely divided by stirring to such an extent that in the subsequent suspension polymerization, a polymer toner having a volume average particle size of generally about 1–50 μm, preferably about 5–30 μm is formed. When the polymerizable monomer composition is subjected to shearing force by stirring in an aqueous dispersion medium containing a dispersing agent, thereby being formed into such minute droplets, it is difficult to bring the oil-soluble polymerization initiator into uniform contact with the individual droplets to unite them when adding a small amount of the oil-soluble polymerization initiator because a great number of the droplets are finely dispersed and stabilized.

Therefore, the present inventors have carried out a further investigation. As a result, it has been found that when a polymerizable monomer composition containing no oil-soluble polymerization initiator is prepared and poured into an aqueous dispersion medium containing a dispersing agent, and an oil-soluble polymerization initiator is then added to the dispersion under stirring, droplets of the composition come into contact with droplets of the polymerization initiator to form droplets of a polymerizable monomer composition containing the polymerization initiator. When shearing force by stirring is applied to such droplets to form minute droplets having desired droplet sizes, and the droplets thus formed are heated to conduct suspension polymerization, a polymer toner homogeneous in composition and uniform in resin properties such as polymerization degree and crosslinking degree can be obtained.

According to this process, the droplets containing the polymerizable monomer are brought into contact with the droplets containing the oil-soluble polymerization initiator in the aqueous dispersion medium, so that temperature control can be performed with ease to prevent both partial polymerization reaction and run-away reaction. In addition, since the minute droplets are formed by stirring under high shearing force, a polymer toner having an even particle size distribution can be obtained. The present invention has been led to completion on the basis of these findings.

According to the present invention, there is thus provided a process for producing a polymer toner, which comprises the steps of:

pouring a polymerizable monomer composition containing at least a polymerizable monomer and a colorant, but containing no oil-soluble polymerization initiator into an aqueous dispersion medium containing a dispersing agent;

adding an oil-soluble polymerization initiator to the polymerizable monomer composition while stirring the composition to form primary droplets thereof, thereby bringing the droplets of the polymerizable monomer composition into contact with droplets of the oil-soluble polymerization initiator to form droplets of a polymerizable monomer composition containing the oil-soluble polymerization initiator;

further continuing the stirring to form secondary droplets having desired droplet sizes; and then conducting suspension polymerization of the polymerizable monomer composition.

According to the present invention, there are provided the following preferred embodiments:

1. A production process wherein the primary droplets of the polymerizable monomer composition have a volume average droplet size of 50–1,000 μm, preferably 100–500 μm; and
2. A production process wherein the dispersing agent is colloid of a hardly water-soluble polyvalent metal hydroxide formed by the reaction of a water-soluble polyvalent metal salt with an alkali metal hydroxide in water.

DETAILED DESCRIPTION OF PREFERRED EMBODIMENTS

Polymerizable monomer

As the polymerizable monomer useful in the practice of the present invention, monomers having a vinyl group are preferably used. Specific examples thereof include vinyl monomers, such as styrene-type monomers such as styrene, vinyltoluene and α-methylstyrene; acrylic acid or methacrylic acid and their derivatives, such as acrylic acid, methacrylic acid, methyl acrylate, ethyl acrylate, propyl acrylate, butyl acrylate, 2-ethylhexyl acrylate, ethyl methacrylate, propyl methacrylate, butyl methacrylate, 2-ethylhexyl methacrylate, dimethylaminoethyl methacrylate, acrylonitrile and acrylamide; ethylenically unsaturated monoolefin such as ethylene, propylene, butylene and isobutylene; vinyl halides such as vinyl chloride, vinylidene chloride, vinyl bromide and vinyl fluoride; vinyl esters such as vinyl acetate and vinyl propionate; vinyl ethers such as vinyl methyl ether and vinyl ethyl ether; vinyl ketones such as vinyl methyl ketone and methyl isopropenyl ketone; and nitrogen-containing vinyl compounds such as 2-vinylpyridine, 4-vinylpyridine and N-vinylpyrrolidone. These monomers may be used either singly or in any combination thereof. Incidentally, a polymerization inhibitor may or may not be caused to coexist in the monomer.

One or more of crosslinkable monomers, for example, aromatic divinyl compounds such as divinylbenzene, divinylnaphthalene and derivatives thereof; di- or triethylenically unsaturated carboxylic acid esters such as ethylene glycol dimethacrylate, diethylene glycol dimethacrylate, triethylene glycol dimethacrylate, trimethylolpropane triacrylate and 1,3-butanediol dimethacrylate; divinyl compounds such as N,N-divinylaniline, divinyl ether, divinyl sulfide and divinyl sulfone; and compounds having at least three vinyl groups, may be used together with the above-mentioned vinyl monomers. These crosslinkable monomers are generally used in a proportion of 0–20 wt. % based on the whole monomer component including the vinyl monomers.

Colorant

As the colorant useful in the practice of the present invention, there may be used pigments and dyes, for example, carbon black, aniline black, Chalcoil Blue, chrome yellow, ultramarine blue, Orient Oil Red, crystal violet, Rhodamine B, Malachite Green, Nigrosine, copper phthalocyanine and azo dyes. These colorants may be used either singly or in any combination thereof.

Metal oxides such as titanium oxide, silicon dioxide and zinc oxide; and magnetic powders such as iron, cobalt, nickel, diiron trioxide, triiron tetraoxide, manganese iron oxide, zinc iron oxide and nickel iron oxide may also be used as the colorants. When a magnetic powder is used to obtain polymer toner particles, finely divided powder having a particle size of 1 μm or smaller is preferably used.

Besides, high-polar substances referred to as the charge control agent in this field, such as nigrosine dyes, monoazo dyes, metallized dyes, zinc hexadecylsuccinate, alkyl esters or alkyl amides of naphthoic acid, nitrohumic acid, N,N'-tetramethyldiamine benzophenone, N,N'-tetramethylbenzidine, triazine and metal complexes of salicylic acid may be used either singly or in any combination thereof.

No particular limitation is imposed on the amount of the colorant to be used, and the amount varies according to the kind of the colorant to be used. However, it is generally used in a proportion of about 0.1–200 parts by weight per 100 parts by weight of the polymerizable monomer. In the case of carbon black, about 1–20 parts by weight suffice.

Dispersing agent

Examples of the dispersing agent useful in the practice of the present invention include water-soluble polymers such as gelatin and polyvinyl alcohol; anionic dispersing agents disclosed in Japanese Patent Application Laid-Open No. 123852/1984; and inorganic dispersing agents such as hardly water-soluble metallic compounds.

Examples of the hardly water-soluble metallic compounds include compounds which exhibit neutrality or alkalinity in water, such as calcium phosphate, magnesium phosphate, calcium sulfate, magnesium carbonate, calcium carbonate, calcium hydroxide and magnesium hydroxide; compounds which exhibit acidity in water, such as aluminum phosphate, zinc phosphate and zinc carbonate; and the like. The hardly water-soluble metallic compound may be formed in situ. For example, when sodium phosphate is reacted with calcium carbonate in water, a hardly water-soluble compound is formed. Therefore, the resultant liquid reaction mixture may be used as an aqueous dispersion medium containing the dispersing agent as it is.

In the present invention, it is preferable to use, as the dispersing agent, colloid of a hardly water-soluble polyvalent metal hydroxide formed by the reaction of a water-soluble polyvalent metal salt with an alkali metal hydroxide in water. When the colloid of the hardly water-soluble polyvalent metal hydroxide is used as the dispersing agent, the stability of the droplets of the polymerizable monomer composition and the droplets of the oil-soluble polymerization initiator does not become very high, so that both droplet components are easy to unite with each other, and uniform mixing is hence achieved with ease.

Examples of the water-soluble polyvalent metal salt include the hydrochlorides, sulfates, nitrates and acetates of polyvalent metals such as magnesium, calcium, aluminum, iron, copper, manganese, nickel and tin. Of these, the use of the magnesium salts or calcium salts is preferred from the viewpoint of dispersion stability. Examples of the alkali metal hydroxide include lithium hydroxide, sodium hydroxide and potassium hydroxide.

When a surfactant is added to the aqueous dispersion medium together with the dispersing agent, the droplets of the polymerizable monomer composition are easily made uniform. It is hence preferable to use the dispersing agent in combination with the surfactant.

Oil-soluble polymerization initiator

As the oil-soluble polymerization initiator useful in the practice of the present invention, may be mentioned peroxide-type initiators, azo-type initiators and the like. The use of an initiator having a solubility in water of 1 wt. % or lower is preferred from the viewpoint of achieving good migration of the initiator to the droplets of the polymerizable monomer composition when stirred in water.

As the oil-soluble polymerization initiator, there may be used any oil-soluble initiator of the peroxide or azo type, which is generally used in suspension polymerization. Specific examples thereof include peroxide-type initiators such as benzoyl peroxide, octanoyl peroxide, orthomethoxybenzoyl peroxide, methyl ethyl ketone peroxide, cumene hydroperoxide, t-butyl hydroperoxide and t-butyl peroxy-2-ethylhexanoate; and azo-type initiators such as 2,2'-azobisisobutyronitrile, 2,2[|m]J-azobis-(2,4-dimethylvaleronitrile), 2,2'-azobis-2,3-dimethylbutyronitrile, 2,2'-azobis-2,3,3-trimethylbutyronitrile, 2,2'-azobis-2-isopropylbutyronitrile, 4,4-azobis-4-cyanovaleric acid and dimethyl 2,2'-azobisisobutyrate.

When an organic peroxide whose ten-hour half-life temperature is 60°–80° C. and whose molecular weight is 250 or lower is used as the oil-soluble polymerization initiator, the odor of the resulting polymer toner attributed to residual monomers can be reduced. The term "ten-hour half-life temperature" as used herein means a temperature at which the half-life of the organic peroxide comes to 10 hours. Specific examples of such organic peroxides include t-butyl peroxy-2-ethylhexanoate, succinamide peroxide, t-hexyl peroxy-2-ethylhexanoate and t-butyl peroxyisobutyrate.

The oil-soluble polymerization initiator is used in a proportion of generally 0.01–20 parts by weight, preferably 0.1–10 parts by weight per 100 parts by weight of the polymerizable monomer.

Other additives

In the present invention, charge control agents such as Spiron Black TRH (product of Hodogaya Chemical Co., Ltd.), Bontron S-34 (product of Orient Chemical Industries Ltd.) and Nigrosine (product of Orient Chemical Industries Ltd.); parting agents such as low-molecular weight polyethylene, low-molecular weight polypropylene; molecular weight modifiers such as t-dodecylmercaptan and n-dodecylmercaptan; and the like may be added to the polymerizable monomer composition.

Production process of polymer toner

In the production process according to the present invention, a colorant and optionally additives (for example, a charge control agent) other than an oil-soluble polymerization initiator are added to a polymerizable monomer, and these components are stirred and mixed to prepare a polymerizable monomer composition comprising the individual components dissolved or dispersed uniformly therein. After the composition is poured into an aqueous dispersion medium containing a dispersing agent, the oil-soluble polymerization initiator is added to the aqueous dispersion medium with stirring. In this step, droplets of the polymerizable monomer composition are brought into contact with droplets of the oil-soluble polymerization initiator, so that both droplet components unite with each other, whereby droplets of a polymerizable monomer composition containing the oil-soluble polymerization initiator are formed.

In the present invention, the time the oil-soluble polymerization initiator is added to the aqueous dispersion medium must be after the polymerizable monomer composition is poured and in the course of forming droplets of the polymerizable monomer component. When the oil-soluble polymerization initiator is added after the polymerizable monomer composition is formed into fine droplets having desired droplet sizes in the aqueous dispersion medium, the oil-soluble polymerization initiator is difficult to uniformly mix with such droplets.

The time the oil-soluble polymerization initiator is added is when the droplet size (volume average droplet size) of the primary droplets formed by the stirring after the pouring of the polymerizable monomer composition comes to generally 50–1,000 μm, preferably 100–500 μm though the time varies according to the intended particle size of the resulting toner. When the period of time from the pouring of the polymerizable monomer composition to the addition of the oil-soluble polymerization initiator is long, the formation of the droplets has been completed, so that the polymerizable monomer composition is not uniformly mixed with the oil-soluble polymerization initiator, resulting in difficulty in making resin properties such as polymerization degree and crosslinking degree uniform at every polymer toner particle. Therefore, the time the oil-soluble polymerization initiator is added is not longer than generally 24 hours, preferably 12 hours, more preferably 3 hours after the pouring of the polymerizable monomer composition on a large scale such as plant, or not longer than generally 5 hours, preferably 3 hours, more preferably 1 hour on a small laboratory scale though it somewhat varies according to reaction scale and the intended particle sizes of the resulting toner.

The temperature of the aqueous dispersion medium between the time the oil-soluble polymerization initiator is added and the subsequent formation of droplets (namely, before initiation of polymerization) is controlled within a range of generally 10°–40° C., preferably 20°–30° C. If the temperature is too high, a partial polymerization reaction is started in the system. If the temperature is too low on the other hand, the flowability of the system is reduced when droplets are formed by stirring, resulting in possibility that it may interfere with the formation of the droplets.

In the present invention, after the droplets of the polymerizable monomer composition are brought into contact with the droplets of the oil-soluble polymerization initiator to form droplets of a polymerizable monomer composition containing the oil-soluble polymerization initiator, the stirring is further continued to form secondary droplets having desired droplet sizes, and suspension polymerization of the polymerizable monomer composition is then conducted. In the step of forming the secondary droplets, the secondary droplets are finely divided to such an extent that in the subsequent suspension polymerization, a polymer toner having a volume average particle size of generally about 1–50 μm, preferably about 5–30 μm is formed. The time the secondary droplets are formed can be optionally set according to the kinds and added amounts of the polymerizable monomer, additives, polymerization initiator and the like, temperature upon the formation of the droplets, the kind of a machine used in the formation of the droplets, and desired droplet sizes. After the conversion of the polymerizable monomer composition into a polymer exceeds 90%, the polymerizable monomer may be additionally added to continue the polymerization. The continuation of the polymerization permits the provision of toner particles of a capsule structure, by which shelf life is improved.

After completion of the suspension polymerization, the resultant polymer is thoroughly washed, dehydrated and dried to collect a polymer toner. When a dispersing agent composed of the hardly water-soluble metallic compound is used, an acid or alkali is added to the system containing a colored particulate polymer (polymer toner) formed after completion of the suspension polymerization to solubilize the dispersing agent composed of the hardly water-soluble metallic compound, and the polymer is then thoroughly washed, dehydrated and dried.

ADVANTAGES OF THE INVENTION

According to the present invention, there can be provided a polymer toner homogeneous in the composition of toner particles and ununiform in resin properties such as polymerization degree and crosslinking degree in accordance with the suspension polymerization method. When the polymer toner obtained by the production process according to the present invention is used as a toner for developing electrostatic latent images in electrophotographic copying machines and the like, bright prints free of fog and scattering spots can be obtained, no offset is caused, and fixing ability is also good.

EMBODIMENTS OF THE INVENTION

The present invention will hereinafter be described more specifically by the following Examples and Comparative Examples. However, this invention is not limited to these examples only.

EXAMPLE 1

Stirred and mixed at 6,000 rpm in a T.K. system homomixer (manufactured by Tokushu Kika Kogyo Co., Ltd.), which is a mixer having high shearing force, were 70 parts by weight of styrene, 30 parts by weight of butyl methacrylate, 0.3 parts by weight of divinylbenzene, 8 parts by weight of carbon black ("Printex 150T", trade name, product of Degussa AG; particle size: 29 nm) and 0.5 parts by weight of a Cr dye ("Bontron S-34", trade name, product of Orient Chemical Industries Ltd.), thereby obtaining a polymerizable monomer composition uniformly dispersed.

On the other hand, an aqueous solution with 6.9 parts by weight of sodium hydroxide dissolved in 50 parts by weight of ion-exchanged water was gradually added to an aqueous solution with 9.8 parts by weight of magnesium chloride dissolved in 250 parts by weight of ion-exchanged water under stirring, thereby preparing a liquid colloidal dispersion of magnesium hydroxide.

The polymerizable monomer composition was then poured into the liquid colloidal dispersion of magnesium hydroxide obtained above, and the temperature of the system was maintained at 20°–30° C. while stirring for 2–3 minutes at a low speed by means of the T.K. system homomixer. At the time primary droplets having a volume average droplet size of about 200 μm were formed, 2 parts by weight of 2,2'-azobisisobutyronitrile were added. The resultant mixture was further stirred at 8,000 rpm by means of the T.K. system homomixer until secondary droplets having a volume average droplet size of about 5 μm were formed. After completion of the step of forming the secondary droplets, the aqueous dispersion containing the secondary droplets of the polymerizable monomer composition containing the initiator was placed in a 1-liter 4-necked flask equipped with a stirrer, thermometer, nitrogen inlet tube and reflux condenser to polymerize the monomer composition under stirring for 8 hours at 65° C.

After the thus-obtained polymer dispersion was thoroughly washed with an acid and water, the resultant polymer was separated and dried to obtain a colored particulate polymer (polymer toner).

The particle size of the thus-obtained polymer toner was measured by a Coulter counter (manufactured by Coulter Co.) and found to be 9.0 μm in terms of volume average particle diameter (dv).

This polymer toner was evaluated by using a commercially-available printer of an electrophotographic system. As a result, bright prints free of fog and scattering spots were obtained though they somewhat gave off odor. In addition, no offset was caused, and fixing ability was also good. The amount of monomers remaining in the polymer toner was measured by means of gas chromatography. As a result, it was found to be 710 ppm.

Comparative Example 1

Stirred and mixed at 6,000 rpm in a T.K. system homomixer (manufactured by Tokushu Kika Kogyo Co., Ltd.), which is a mixer having high shearing force, were 70 parts by weight of styrene, 30 parts by weight of butyl methacrylate, 0.3 parts by weight of divinylbenzene, 8 parts by weight of carbon black ("Printex 150T", trade name, product of Degussa AG) and 0.5 parts by weight of a Cr dye ("Bontron S-34", trade name, product of Orient Chemical Industries Ltd.), thereby obtaining a polymerizable monomer composition uniformly dispersed.

On the other hand, an aqueous solution with 6.9 parts by weight of sodium hydroxide dissolved in 50 parts by weight of ion-exchanged water was gradually added to an aqueous solution with 9.8 parts by weight of magnesium chloride dissolved in 250 parts by weight of ion-exchanged water under stirring, thereby preparing a liquid colloidal dispersion of magnesium hydroxide.

The polymerizable monomer composition was then poured into the liquid colloidal dispersion of magnesium hydroxide obtained above, and the resultant mixture was subjected to high-shear stirring at 8,000 rpm by means of the T.K. system homomixer while maintaining the temperature of the system at 20°–30° C., thereby forming droplets of the polymerizable monomer composition having a volume average droplet size of about 5 μm.

After completion of the step of forming the droplets, 2 parts by weight of 2,2'-azobisisobutyronitrile were added to the aqueous dispersion containing the droplets of the polymerizable monomer composition, and the resultant mixture was placed in a 1-liter 4-necked flask equipped with a stirrer, thermometer, nitrogen inlet tube and reflux condenser to polymerize the monomer composition under stirring for 8 hours at 65° C.

After the thus-obtained polymer dispersion was thoroughly washed with an acid and water, the resultant polymer was separated and dried. However, particles of the polymer aggregated in the drying step, so that no satisfactory colored particulate polymer (polymer toner) could be obtained. The amount of monomers remaining in this aggregate was very large, and it is hence considered that the polymerization reaction was not completed because the dispersion of the polymerization initiator was uneven.

Comparative Example 2

Stirred and mixed at 6,000 rpm in a T.K. system homomixer (manufactured by Tokushu Kika Kogyo Co., Ltd.), which is a mixer having high shearing force, were 70 parts by weight of styrene, 30 parts by weight of butyl methacrylate, 0.3 parts by weight of divinylbenzene, 8 parts by weight of carbon black ("Printex 150T", trade name, product of Degussa AG), 0.5 parts by weight of a Cr dye ("Bontron S-34", trade name, product of Orient Chemical Industries Ltd.) and 2 parts by weight of 2,2'azobisisobutyronitrile, thereby obtaining a polymerizable monomer composition uniformly dispersed.

On the other hand, an aqueous solution with 6.9 parts by weight of sodium hydroxide dissolved in 50 parts by weight of ion-exchanged water was gradually added to an aqueous solution with 9.8 parts by weight of magnesium chloride dissolved in 250 parts by weight of ion-exchanged water under stirring, thereby preparing a liquid colloidal dispersion of magnesium hydroxide.

The polymerizable monomer composition containing the oil-soluble polymerization initiator prepared above was then poured into the liquid colloidal dispersion of magnesium hydroxide obtained above, and the resultant mixture was subjected to high-shear stirring at 8,000 rpm by means of the T.K. system homomixer while maintaining the temperature of the system at 20°–30° C., thereby forming droplets of the polymerizable monomer composition having a volume average droplet size of about 5 μm.

The aqueous dispersion containing the droplets of the polymerizable monomer composition was placed in a 1 liter 4-necked flask equipped with a stirrer, thermometer, nitrogen inlet tube and reflux condenser to polymerize the monomer composition under stirring for 8 hours at 65° C.

After the thus-obtained polymer dispersion was thoroughly washed with an acid and water, the resultant polymer was separated and dried to obtain a colored particulate polymer (polymer toner).

The particle size of the thus-obtained colored fine particles was 9.8 μm in terms of volume average particle size. However, fine and coarse powders were generated in plenty, and so the particle size distribution of the toner obtained was wide. This is considered to be attributable to the fact that polymerization is partially started during the high-shear stirring of the polymerizable monomer composition, resulting in increase in viscosity of the polymerizable monomer composition.

EXAMPLE 2

An experiment was performed in the same manner as in Example 1 except that t-butyl peroxy-2-ethylhexanoate was used as the oil-soluble polymerization initiator in place of 2,2'-azobisisobutyronitrile in Example 1.

The particle size of the thus-obtained polymer toner was measured by a Coulter counter (manufactured by Coulter Co.) and found to be 6.8 μm in terms of volume average particle diameter (dv). This polymer toner was evaluated by using a commercially-available printer of an electrophotographic system. As a result, bright prints free of fog and scattering spots were obtained without giving off odor. In addition, no offset was caused, and fixing ability was also good. The amount of monomers remaining in the polymer toner was measured by means of gas chromatography. As a result, it was found to be 240 ppm.

EXAMPLE 3

An experiment was performed in the same manner as in Example 1 except that t-butyl peroxy-2-ethylhexanoate was used as the oil-soluble polymerization initiator in place of 2,2'-azobisisobutyronitrile in Example 1, and was added at the time the volume average droplet size of the primary droplets of the polymerizable monomer composition came to 300 μm.

The particle size of the thus-obtained polymer toner was measured by a Coulter counter (manufactured by Coulter Co.) and found to be 7.0 μm in terms of volume average particle diameter (dv). This polymer toner was evaluated by using a commercially-available printer of an electrophotographic system. As a result, bright prints free of fog and scattering spots were obtained without giving off odor. In addition, no offset was caused, and fixing ability was also good. The amount of monomers remaining in the polymer toner was measured by means of gas chromatography. As a result, it was found to be 400 ppm.

We claim:

1. A process for producing a polymer toner, which comprises the steps of:

pouring a polymerizable monomer composition (A) containing at least a polymerizable monomer and a colorant, but containing no oil-soluble polymerization initiator, into an aqueous dispersion medium containing a dispersing agent;

stirring the aqueous dispersion medium to form primary droplets of the polymerizable monomer composition (A) therein;

adding an oil-soluble polymerization initiator to the aqueous dispersion medium, at the time the volume average droplet size of the primary droplets comes to a droplet size within a range of 50–1,000 μm, while stirring the aqueous dispersion medium, thereby bringing the primary droplets into contact with droplets of the oil-soluble polymerization initiator to form droplets of the resulting polymerizable monomer composition (B) containing the oil-soluble polymerization initiator;

further stirring the aqueous dispersion medium to form secondary droplets of the polymerizable monomer composition (B) having a desired droplet size; and then conducting suspension polymerization of the polymerizable monomer composition (B).

2. The process according to claim 1, wherein the polymerizable monomer comprises a crosslinkable monomer in a proportion of 20 wt. % or lower.

3. The process according to claim 1, wherein the polymerizable monomer comprises a styrene monomer, a (meth) acrylic ester and an aromatic divinyl compound.

4. The process according to claim 1, wherein the dispersing agent is colloid of a hardly water-soluble polyvalent metal hydroxide formed by the reaction of a water-soluble polyvalent metal salt with an alkali metal hydroxide in water.

5. The process according to claim 1, wherein the oil-soluble polymerization initiator has a solubility in water of 1 wt. % or lower.

6. The process according to claim 1, wherein the oil-soluble polymerization initiator is a peroxide or azo oil-soluble initiator.

7. The process according to claim 1, wherein the oil-soluble polymerization initiator is an organic peroxide whose ten-hour half-life temperature is 60°–80° C. and whose molecular weight is 250 or lower.

8. The process according to claim 1, wherein the secondary droplets are formed so as to have droplet sizes within a range of 1–50 μm.

9. The process according to claim 1, wherein the secondary droplets are formed so as to have droplet sizes within a range of 5–30 μm.

10. A process for producing a polymer toner, which comprises the steps of:

pouring a polymerizable monomer composition (A) containing at least a polymerizable monomer and a colorant, but containing no oil-soluble polymerization initiator, into an aqueous dispersion medium containing a dispersing agent;

stirring the aqueous dispersion medium to form primary droplets of the polymerizable monomer composition (A) therein;

adding an oil-soluble polymerization initiator to the aqueous dispersion medium at the time the volume average droplet size of the primary droplets come to a droplet size within a range of 100–500 μm, while stirring the aqueous dispersion medium, thereby bringing the primary droplets into contact with droplets of the oil-soluble polymerization initiator to form droplets of the resulting polymerizable monomer composition (B) containing the oil-soluble polymerization initiator;

further stirring the aqueous dispersion medium to form secondary droplets of the polymerizable monomer composition (B) having a desired droplet size; and then conducting suspension polymerization of the polymerizable monomer composition (B).

11. A process for producing a polymer toner, which comprises the steps of:

pouring a polymerizable monomer composition (A) containing at least a polymerizable monomer and a colorant, but containing no oil-soluble polymerization initiator into an aqueous dispersion medium containing a dispersing agent, which is a colloid of a hardly water-soluble polyvalent metal hydroxide formed by the reaction of a water-soluble polyvalent metal salt, which is at least one selected from the group consisting of magnesium salts and calcium salts, with an alkali metal hydroxide, which is at least one selected from the group consisting of sodium hydroxide, lithium hydroxide and potassium hydroxide, in water;

stirring the aqueous dispersion medium to form primary droplets of the polymerizable monomer composition (A) therein;

adding an oil-soluble polymerization initiator to the aqueous dispersion medium while stirring the aqueous dispersion medium, thereby bringing the primary droplets into contact with droplets of the oil-soluble polymerization initiator to form droplets of the resulting polymerizable monomer composition (B) containing the oil-soluble polymerization initiator;

further stirring the aqueous dispersion medium to form secondary droplets of the polymerizable monomer composition (B) having a desired droplet size; and then conducting suspension polymerization of the polymerizable monomer composition (B).

12. The process according to claim 11, wherein the dispersing agent is colloid of hardly water-soluble magnesium hydroxide formed by the reaction of a water-soluble magnesium salt with sodium hydroxide in water.

13. A process for producing a polymer toner, which comprises the steps of:

pouring a polymerizable monomer composition (A) containing at least a polymerizable monomer and a colorant, but containing no oil-soluble polymerization initiator, into an aqueous dispersion medium containing a dispersing agent;

stirring the aqueous dispersion medium to form primary droplets of the polymerizable monomer composition (A) therein;

adding an oil-soluble polymerization initiator, which is at least on selected from the group consisting of t-butyl peroxy-2-ethylhexanoate, succinamide peroxide, t-hexyl peroxy-2-ethylhexanoate and t-butyl peroxyisobutyrate, to the aqueous dispersion medium while stirring the aqueous dispersion medium, thereby bringing the primary droplets into contact with droplets of the oil-soluble polymerization initiator to form droplets of the resulting polymerizable monomer composition (B) containing the oil-soluble polymerization initiator;

further stirring the aqueous dispersion medium to form secondary droplets of the polymerizable monomer composition (B) having a desired droplet size; and then conducting suspension polymerization of the polymerizable monomer composition (B).

14. A process for producing a polymer toner, which comprises the steps of:

pouring a polymerizable monomer composition (A) containing at least a polymerizable monomer and a colorant, but containing no oil-soluble polymerization initiator, into an aqueous dispersion medium containing a dispersing agent;

stirring the aqueous dispersion medium to form primary droplets of the polymerizable monomer composition (A) therein;

adding an oil-soluble polymerization initiator to the aqueous dispersion medium, and controlling the temperature of the aqueous dispersion medium within a range of 10°–40° C., while stirring the aqueous dispersion medium, thereby bringing the primary droplets into contact with droplets of the oil-soluble polymerization initiator to form droplets of the resulting polymerizable monomer composition (B) containing the oil-soluble polymerization initiator;

further stirring the aqueous dispersion medium to form secondary droplets of the polymerizable monomer composition (B) having a desired droplet size; and then conducting suspension polymerization of the polymerizable monomer composition (B).

* * * * *